United States Patent [19]

Geyler, Jr. et al.

[11] Patent Number: 4,526,201

[45] Date of Patent: Jul. 2, 1985

[54] FOUR-WAY VALVE WITH INTERNAL PILOT

[75] Inventors: Arthur H. Geyler, Jr.; Ted L. Teach, both of Dayton, Ohio

[73] Assignee: Spectra-Physics, Inc., Mountain View, Calif.

[21] Appl. No.: 439,057

[22] Filed: Nov. 4, 1982

[51] Int. Cl.[3] ..... F15B 13/043

[52] U.S. Cl. ..... 137/625.63; 137/625.64; 251/137; 251/285

[58] Field of Search ..... 137/625.63, 625.64; 251/285, 137

[56] References Cited

U.S. PATENT DOCUMENTS

| | | | |
|---|---|---|---|
| 1,125,825 | 1/1915 | Englesson | 137/625.63 |
| 2,600,348 | 6/1952 | Walthers | 137/625.6 |
| 2,655,940 | 10/1953 | Jackson | 137/625.63 |
| 2,771,907 | 11/1956 | Joy | 137/625.63 X |
| 2,952,246 | 9/1960 | Collins . | |
| 2,954,050 | 9/1960 | Burton . | |
| 3,060,969 | 10/1962 | Aslan | 137/625.63 |
| 3,283,784 | 11/1966 | Ruchser . | |
| 3,294,120 | 12/1966 | Ruchser . | |
| 3,412,971 | 11/1968 | McDivitt | 251/137 |
| 3,554,234 | 1/1971 | Kurtz . | |
| 3,603,348 | 9/1971 | Wright . | |
| 3,870,074 | 3/1975 | Hanser et al. . | |
| 3,874,405 | 4/1975 | Thayer . | |
| 3,918,488 | 11/1975 | Minami . | |
| 3,924,656 | 12/1975 | Hanser et al. . | |
| 4,067,357 | 1/1978 | Ruchser . | |
| 4,245,671 | 1/1981 | Kosugui . | |
| 4,276,896 | 7/1981 | Hunck et al. . | |
| 4,293,002 | 10/1981 | Moriyama et al. . | |

FOREIGN PATENT DOCUMENTS

| | | | |
|---|---|---|---|
| 2506864 | 8/1976 | Fed. Rep. of Germany | 137/625.64 |

*Primary Examiner*—Gerald A. Michalsky

*Attorney, Agent, or Firm*—Fraser & Clemens

[57] ABSTRACT

A four-way valve for selectively controlling the application of fluid and exhaust pressures to opposite sides of a double acting cylinder utilizes a main valve spool that is axially movable in a valve housing defining ports respectively connected to opposite sides of the cylinder and to the pressured and inlet sides of a fluid pressure source. The spool valve is provided with an axial bore and a pilot spool is mounted in such axial bore. Radial passages are provided in the main valve spool connecting its exterior with the axial bore and external sealing portions on the pilot spool cooperate with the radial port so that in a neutral position of both the main valve spool and the pilot spool, no fluid flow occurs. Upon axial shifting of the pilot spool in either direction from the neutral position, fluid pressure is applied to opposite ends of the main valve spool to cause it to follow the pilot spool and thus effect a connection between the outlet and inlet ports of the fluid pressure source and the appropriate side of the double acting cylinder.

4 Claims, 5 Drawing Figures

FOUR-WAY VALVE WITH INTERNAL PILOT

BACKGROUND OF THE INVENTION

1. Field of the Invention

The invention relates to a four-way spool type valve for controlling the respective application of fluid pressure and exhaust pressure to opposite sides of a double acting piston disposed within a cylinder, wherein the pilot valve for controlling the movements of the valve spool is contained within an axial bore extending through the valve spool.

2. Description of the Prior Art

A four-way hydraulic valve for the selective application of fluid pressure and exhaust pressure respectively to opposite sides of a double acting piston-cylinder combination has been heretofore utilized in many industrial applications. Where substantial fluid pressures are involved, the four-way valve generally has to be of substantial size in order to withstand the pressures applied to the double acting cylinder. Such control valve has generally taken the form of an outer housing containing axially spaced radial ports which are respectively connectable to the pressure and exhaust side of a fluid pressure source and the opposite sides of the cylinder containing the double acting piston. The flow of fluid through the proper ports is normally controlled by an axially shiftable spool mounted within the ported housing and having external sealing elements for effecting the required separation of the various ports in accordance with the axial position of the spool relative to such ports. To effect the rapid shifting of the valve spool in order to expedite the application of proper control pressures to the double acting cylinder, it has been common to apply differential fluid pressures to the ends of the spool through the medium of a relatively small pilot valve, which is operated either manually or by an electrical or hydraulic actuator. The employment of a separate pilot valve inherently involves the utilization of separate fluid pressure conduits leading from the pilot valve to the main spool type valve, with an attendant increase in total bulk of the valving package, increased cost of assembly, and increased risk of failure of the valve due to rupture of the exposed external piping.

There is a need, therefore, for a four-way spool type hydraulic valve employing a pilot valve to effect the control movements of the spool of the four-way valve, wherein the pilot valve may be incorporated as an internal part of the spool valve and any external conduits connecting the pilot valve to the spool valve may be eliminated.

Moreover, there is often a need for convenient adjustment of the speed of operation of a double acting cylinder controlled by a four-way spool valve.

SUMMARY OF THE INVENTION

The invention contemplates the provision of an axial bore in the spool of an otherwise conventional four-way hydraulic spool valve. Within such axial bore, there is slidably mounted a pilot spool element. One end of the pilot spool element extends axially out of the valve spool bore and is connected to means for effecting an axial displacement of the pilot spool relative to the main valve spool. Such means may, for example, comprise a pair of solenoids surrounding a magnetic core element which is secured to the pilot valve so that selective energization of one of the solenoids effects the shifting of the pilot spool in one or the other axial direction.

A plurality of radial ports are provided in the main valve spool respectively connecting the valve spool bore with two conduits in the main valve housing which are connected to the return side of the hydraulic pressure source and with a single conduit connected to the pressure side of the hydraulic pressure source. The pilot spool is provided with axially spaced sealing shoulders which, in the neutral position of the pilot spool relative to the main valve spool, respectively close each of the radial ports in the main valve spool. The pilot spool is normally held in such neutral position by a centering spring.

Axial displacement of the pilot spool by the external means provided for such purpose effects the connection of the fluid pressure conduit to one end of the main valve spool and the exhaust or return fluid conduit to the other end of such spool. Such fluid pressure differential effects a shifting of the main spool to effect the connection of one side of the double acting cylinder controlled by the four-way valve to the pressure source while the other side is connected to the exhaust or return fluid conduit, hence effecting the actuation of the double acting cylinder. Such movement of the main spool valve constitutes an exact following movement of the shifting of the pilot spool so that these two elements again resume a neutral position relative to each other where the fluid pressures on the opposite ends of the main valve spool are again balanced, and the main valve spool remains in its described energizing condition until the pilot spool is shifted in the opposite direction by its actuating means.

The movement of the pilot spool past its neutral position in an opposite direction effects a reversal of the application of fluid pressure and exhaust pressure respectively to the opposite ends of the main valve spool, and thus shifts the main valve spool in a direction opposite to that previously described. Such axial shifting movement of the main valve spool reverses the application of fluid pressure and exhaust pressure to the sides of the double acting cylinder and thus effects a reversal of the operation of such cylinder. Again, the movement of the main valve spool exactly follows the movement of the pilot valve and it again assumes the neutral position with respect to the pilot valve wherein the fluid pressures operating on the ends of the main valve spool are equalized.

Whenever the actuating force is removed from the pilot spool, the pilot spool returns to its original neutral position through the action of the centering spring, and the spool of the four-way valve is returned to its initial position wherein no fluid pressure is applied to the double acting cylinder controlled by such valve.

The fact that the main spool exactly follows the axial movements of the pilot spool permits a throttling action to be imposed on fluid flow to the controlled cylinder simply by adjusting the limits of movement of the pilot spool.

Further objects and advantages of the invention will be readily apparent to those skilled in the art from the following detailed description, taken in conjunction with the annexed sheets of drawings on which is shown a preferred embodiment of the invention.

DESCRIPTION OF THE PREFERRED EMBODIMENT

Figure 1:
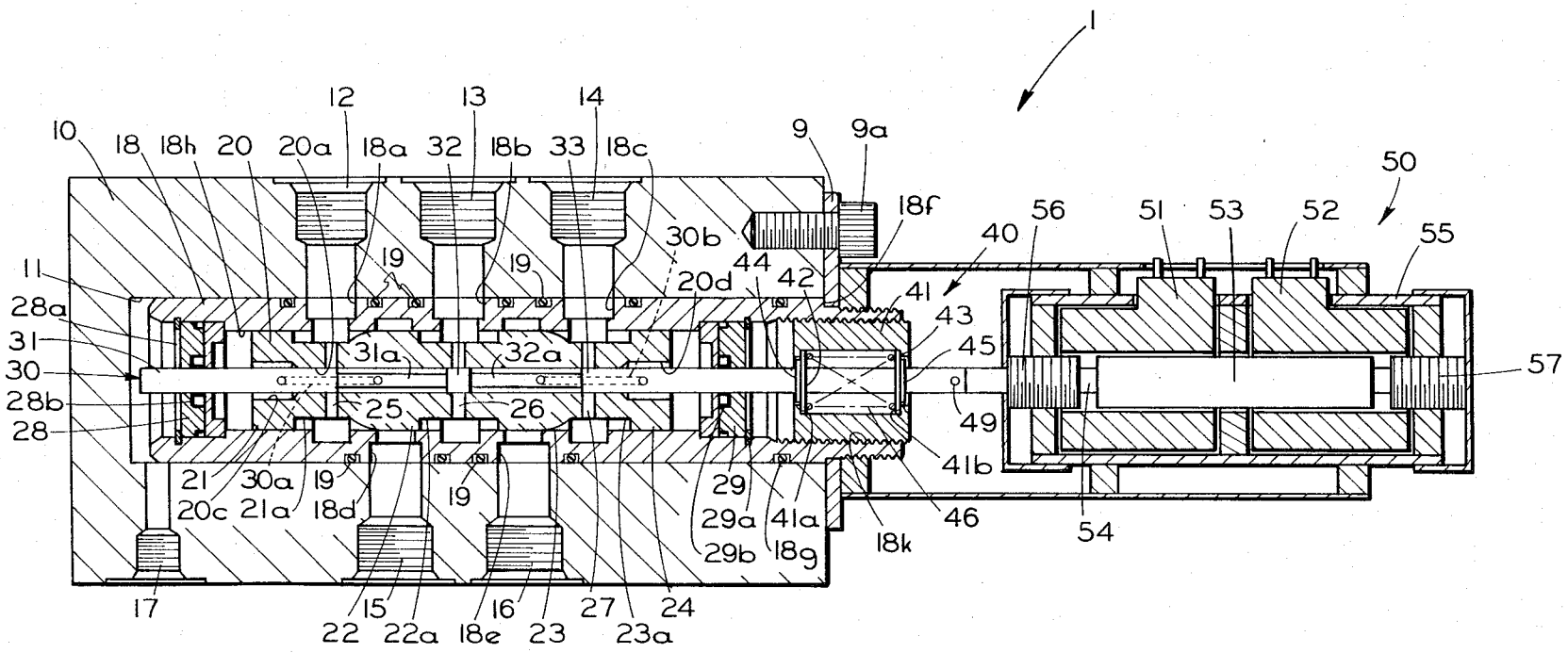
FIG. 1 is a vertical sectional view of a four-way hydraulic valve incorporating this invention, with the elements of the valve shown in their neutral or de-energizing positions.

Referring to FIG. 1, there is shown a complete four-way spool type valve 1 embodying this invention. Such valve comprises an outer main housing 10 defining a central bore 11 which is open only at one end. Housing 10 is provided with a plurality of axially spaced radial ports 12, 13, 14, 15, 16 and 17, each extending from the periphery of the housing 10 into communication with the bore 11. Each port is internally threaded to receive a correspondingly threaded end of a conduit in the case of ports 12 through 16, and to receive a plug in the case of port 17.

Ports 15 and 16 are respectively adapted for connection to opposite ends of a conventional double acting cylinder, (not shown) i.e., a cylinder having a piston medially disposed therein and fluid pressure chambers disposed on each side of such piston so that the application of a fluid pressure differential to opposite sides of the piston produces a corresponding movement of the piston in the cylinder. Port 13 is adapted for connection to the pressured outlet side of a fluid pressure source (not shown) and ports 12 and 14, which are respectively axially spaced on opposite sides of port 13, are adapted for connection to the return or inlet of the fluid pressure source. Port 17 is located adjacent the extreme inner end of the housing bore 11 and is provided solely for the purpose of draining the valve 1 by removal of a plug therefrom (not shown).

Figure 5:
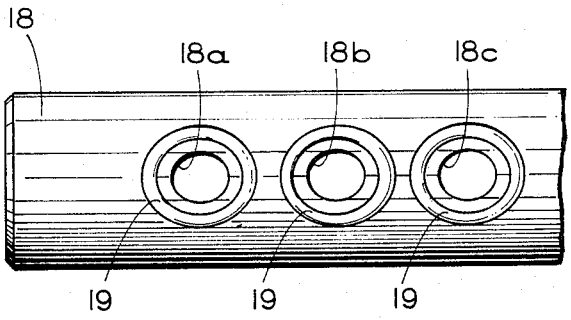
FIG. 5 is a fragmentary elevational view of the ported portion of the valve sleeve housing.

While the housing 10 could be employed alone to directly mount an axially reciprocable valve spool 20 therein, this invention preferably utilizes an intermediate sleeve housing 18 which is fixedly and sealably mounted within the bore 11 of the outer housing 10. Sleeve 18 may thus be economically fabricated from a metal having better anti-friction characteristics for the mounting of the main valve spool 20 therein. Valve sleeve 18 is provided with radial ports 18*a*, 18*b*, 18*c*, 18*d*, and 18*e* respectively alignable with the ports 12, 13, 14, 15, and 16 provided in the main valve housing 10. O-ring seals 19 (FIG. 5) are mounted in circular slots cut around the exterior perimeter of the respective ports 18*a*–18*e* to effect a sealing engagement between bore 11 of the outer valve housing 10 and the inner sleeve housing 18. Sleeve housing 18 is secured in its inserted position in the main housing bore 11 by a plate 9 which is centrally apertured to abut a shoulder 18*f* provided on the sleeve housing 18 and is secured to the end face of the main valve housing 10 by one or more bolts 9*a*. An O-ring seal 18*g* is mounted in the outer end of sleeve housing 18 and effects a further seal between the sleeve housing 18 and the bore 11 of the main housing 10.

Within the polished bore 18*h* of the housing sleeve 18, there is mounted a valve spool 20 for axially slidable movements. Spool 20 is provided with axially spaced external sealing shoulders 21, 22, 23 and 24. Between the adjacent shoulders the external surface of the valve spool is recessed, as indicated at 21*a*, 22*a*, and 23*a*. In a neutral or inoperative position of the valve spool 20 with respect to the ports 12 through 16, the sealing shoulders are disposed so as to isolate the various ports from each other and prevent all fluid flow through the valve 1 to the controlled cylinder. The annular recesses 21*a*, 22*a*, and 23*a* are in turn respectively connected to a bore 20*a* extending through the valve spool 20 by a plurality of radial ports 25, 26 and 27.

The extent of axial displacement of valve spool 20 relative to housing sleeve 18 is respectively limited in each direction by annular seal structures 28 and 29 which are respectively held in a fixed position within the bore 18*h* of housing sleeve 18 by C-rings 28*a* and 29*a* respectively.

In accordance with this invention, a pilot spool 30 is mounted for axial movements within the axial bore 20*a* of the spool valve 20 and is sealingly engaged by seal elements 28*b* and 29*b* provided in the annular seal structures 28 and 29. Pilot spool 30 is provided with axially spaced sealing portions 31, 32 and 33, which, in the neutral position of the pilot spool 30 relative to the valve spool 20 are respectively disposed in overlying relationship to the radial ports 25, 26 and 27 when the pilot spool 30 is disposed in a neutral position with respect to the main spool valve 20. External recesses 31*a* and 32*a* are formed intermediate shoulders 31, 32 and 33.

Pilot valve 30 is held in the aforesaid neutral position by a centering spring mechanism 40 comprising an annular housing 41 which is externally threaded into internal threads 18*k* provided in the end of the housing sleeve 18. The spring centering housing 41 defines two axially spaced internally projecting shoulders 41*a* and 41*b* which respectively define stops for annular spring seats 42 and 43, which are in abuttment with C-rings 44 and 45 secured to the pilot spool 30. A spring 46 between spring seats 42 and 43 resiliently maintains the pilot spool 30 in its aforesaid neutral position relative to the main valve spool 20.

In the neutral position of the pilot spool 30, a pair of generally U-shaped fluid passages 30*a* and 30*b* provided in the body of the pilot spool 30 respectively extend from a position axially inward from the recessed portions 31*a* and 32*a* of the pilot spool 30 to two outlets on the pilot spool which are respectively disposed within enlarged counter bores 20*c* and 20*d* provided in the ends of the bore 20*a* of the valve spool 20.

The end of the valve spool 30 projecting axially beyond the centering spring mechanism 40 is secured, as by a transverse pin 49, to an actuating mechanism 50 which may be either manually, electrically or hydraulically operated to effect a selective shifting of the pilot spool 30 in either direction from the aforesaid neutral position. In the example illustrated in these drawings, the actuating mechanism 50 comprises a pair of axially spaced solenoid coils 51 and 52 which respectively cooperate with a ferro-magnetic core 53 which is secured to a shaft 54, which in turn is secured to the pilot spool 30 by the transverse pin 49. An external housing 55 is provided for mounting solenoid coils 51 and 52 and also provides a threaded mounting for adjustable end stops 56 and 57 which permit selective adjustment of the amount of axial displacement of the pilot spool 30 to be effected through the selective actuation of either solenoid coil 51 or solenoid coil 52.

As will be understood by those skilled in the art, whenever actuation of the four-way valve 1 is desired to effect the operation of the double acting cylinder controlled by such valve in a particular direction, an electrical signal will be applied to either solenoid coil 51 or solenoid coil 52 to selectively shift the pilot spool 30 in one or the other axial direction to effect the required shifting of the valve spool 20 in the direction required to effect the connection of the fluid pressure port 13 with the correct side of the double acting cylinder (not shown) and one of the exhaust or return ports 12 or 14 with the other side of such double acting cylinder.

Figure 2:
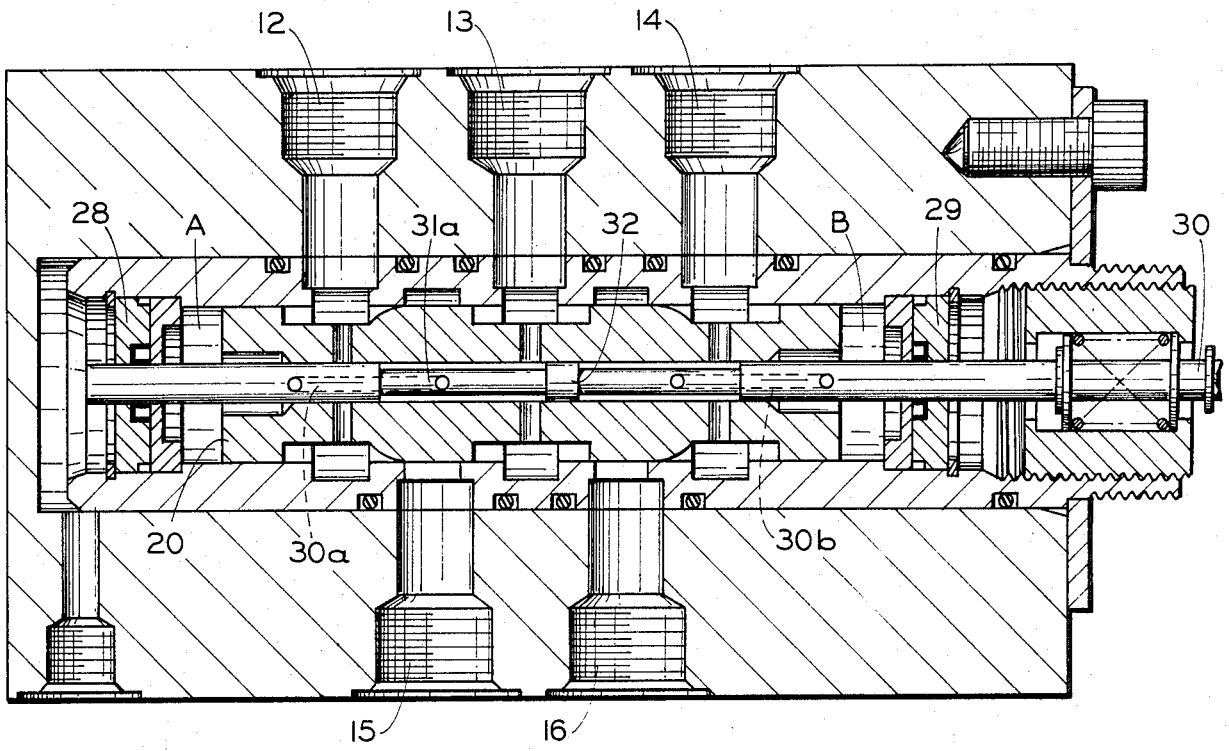
FIG. 2 is an enlarged scale view of a portion of FIG. 1, but illustrating the position of the pilot spool when it is axially shifted in one direction by the actuating solenoid.
Figure 3:
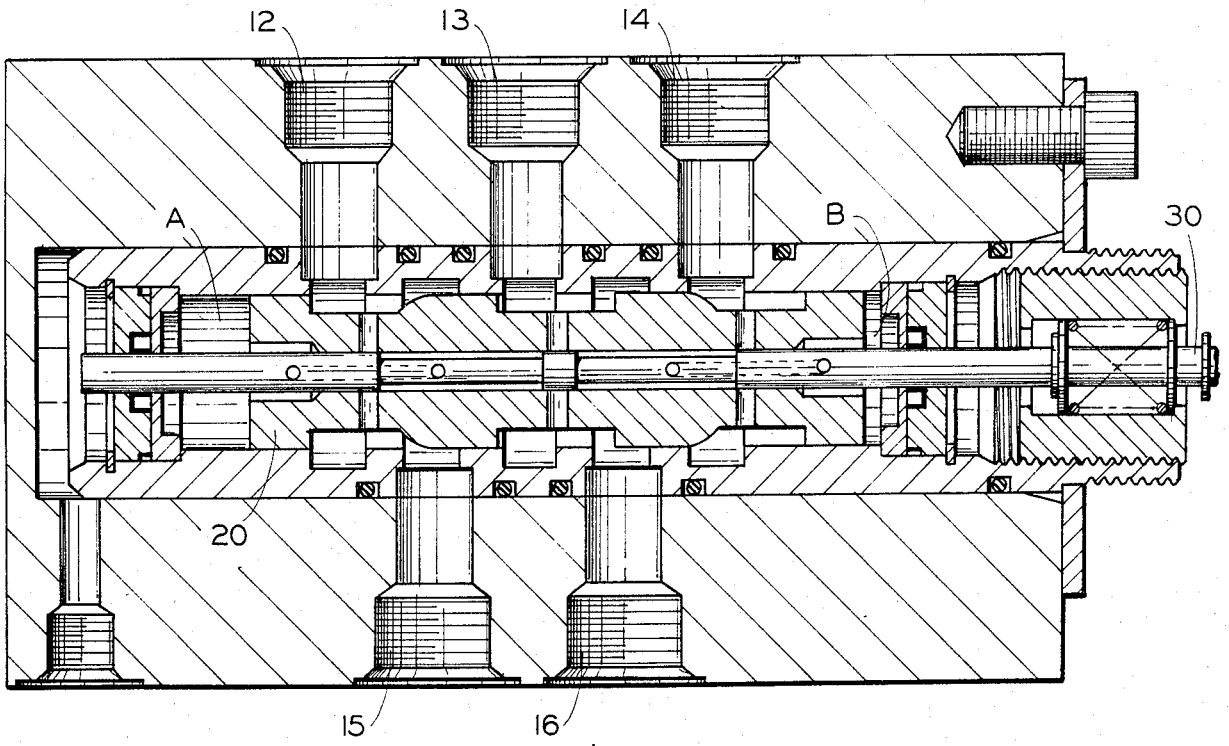
FIG. 3 is a view similar to FIG. 2 but illustrating the position assumed by the main valve spool in response to the axial shifting of the pilot spool.
Figure 4:
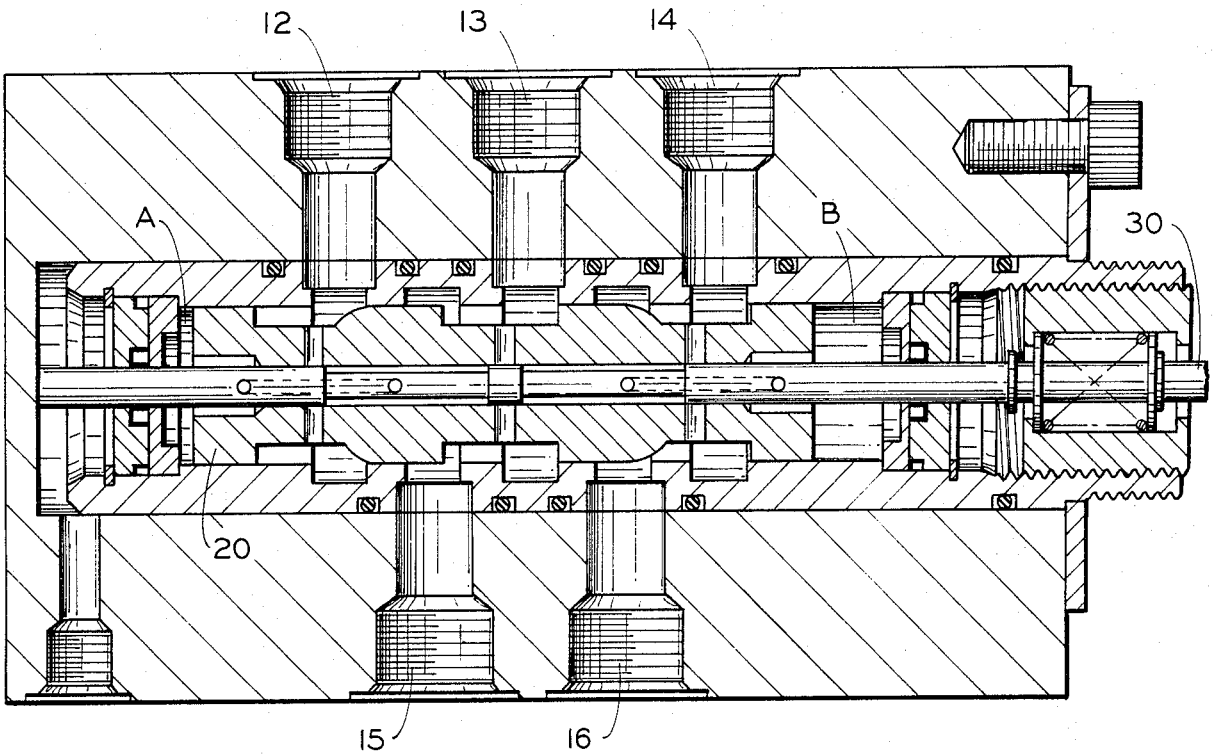
FIG. 4 is a view similar to FIG. 3 but showing the positions assumed by the pilot spool and the main spool valve in response to an actuation of the pilot spool in an opposite direction.

The operation of the aforedescribed device may be best understood by referring to the enlarged scale drawings of FIGS. 2, 3 and 4. In FIG. 2, it is assumed that an appropriate electrical signal has been applied to the actuating mechanism 50 to effect the shifting of the pilot spool 30 to the right. This action removes the central valving shoulder 32 of the pilot valve 30 from its position of alignment with the radial port 26 and permits fluid pressure to flow from the fluid pressure outlet connected port 13 through the annular recess 31*a* and into the fluid passage 30*a* provided in the pilot spool 30 to apply fluid pressure to the chamber A defined between the annular sealing mechanism 28 and the end face of the main valve spool 20. Concurrently, exhaust pressure is established in the fluid pressure chamber B defined between the opposite end face of the main valve spool 20 and the annular fluid sealing mechanism 29 by virtue of fluid flow from the exhaust or return port 14 through the internal fluid passage 30*b* in the pilot spool 30. Thus a fluid pressure differential is applied to the main spool 20 in the direction to cause such main spool to precisely follow the axial displacement of the pilot spool 30, as illustrated in FIG. 3.

Referring now to FIG. 3, wherein the main spool 20 is shown in its axially shifted position, it should be first noted that the main spool 20 resumes its neutral position relative to the pilot spool 30 and that the fluid pressures on the opposite end faces of the main spool 20 in the chambers A and B are again balanced. Additionally, however, the fluid pressure port 13 which connects with the outlet side of the fluid pressure source (not shown) is now connected directly to the radial port 16 leading to one side of the double acting cylinder (not shown) while the other side of such cylinder is connected through port 15 to the exhaust or return port 12 which is connected to the inlet side of the fluid pressure source. Thus the double acting cylinder controlled by the four way valve will have been shifted in the desired direction.

Referring now to FIG. 4, there is shown the position of the main spool 20 and the pilot spool 30 when shifting of the double acting piston to be controlled is required in the opposite direction. Here, the pilot spool 30 is first moved to the left by the actuating mechanism 50, and the main spool 20 immediately follows such axial movement by virtue of the establishment of a fluid pressure differential in the chambers A and B at the opposite ends of the valve spool 20 to cause it to follow the pilot spool and again resume a neutral position with respect to the pilot spool 30. In this left hand position, the port 15 is now connected to the outlet side of the fluid pressure source while the port 16 is connected to the return or inlet side of the fluid pressure source through port 14. Thus, operation of the valve to be controlled in the opposite direction has been achieved.

Under either conditions of operation, upon removal of the controlling signal from the actuating mechanism 50, resulting in the de-energization of the solenoid 51 or 52 as the case may be, the pilot spool 30 is returned to its original neutral position by the centering spring 46. This causes the main spool 20 to follow the pilot spool 30 through the establishment of differential pressures in the chambers A and B and the entire valving unit returns to the neutral or inoperative position illustrated in FIG. 1.

The fact that the main spool 20 exactly follows the axial displacement movements of the pilot spool 30 may be advantageously utilized to produce a throttling control of the amount of fluid to be transmitted to the double acting cylinder to be controlled by the valve 1. Thus, adjustment of the threaded end stops 56 and 57 provided in the pilot spool actuating mechanism 50 will limit the axial movement of pilot spool 30 and will correspondingly limit the following movement of the main valve spool 20. This movement may be reduced to the extent that a throttling action is imposed on the fluid passages established by the axial shifting of the main valve spool 20, thus limiting the amount of fluid flow to the cylinder to be controlled. Hence, a four-way valve incorporating this invention not only permits the selective actuation of a double acting cylinder in either direction, but also permits adjustment of the rate of flow of fluid to said cylinder to control the rate of movement of the cylinder in the desired direction.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A valve for selectively connecting the inlet and outlet of a fluid pressure source to a fluid pressure chamber incorporating a fluid pressure responsive piston, comprising, in combination: a hollow housing having an axially spaced pair of first radial ports connectable respectively to said fluid pressure chamber on opposite sides of said piston, an axially spaced pair of second radial ports connectable respectively with said inlet and outlet of the fluid pressure source; said first ports being respectively axially adjacent said second ports; a valve spool axially slidable in the bore of said hollow housing; said valve spool having axially spaced external seal elements cooperable with said housing bore and recessed external surfaces intermediate said external seal elements, whereby in a neutral axial position of said spool no fluid flow occurs, in one axial position of said spool away from said neutral position pressurized fluid flows through said pair of first ports in one direction, and in a second axial position of said spool in the opposite direction from said neutral position the flow of pressurized fluid through said pair of first ports is reversed; said valve spool having an axial bore and radial ports connecting said valve spool bore with said recessed external surfaces, a pilot spool axially shiftably mounted in said valve spool bore; external sealing means on said pilot spool respectively sealing each of said radial ports in a neutral position of said pilot spool relative to said valve spool; a pair of axially extending passages respectively extending from a region intermediate said external sealing means on said pilot spool to an axial end region of said hollow housing; and adjustable means for axially shifting said pilot valve a predetermined distance in either direction from its said neutral position, said adjustable means including a solenoid core secured to said pilot spool, a first solenoid coil axially spaced from a second solenoid coil, said first and second solenoid coils cooperable with said solenoid core to respectively shift said solenoid core in opposite directions upon respective energization of said solenoid coils, a first threadably adjustable stop means associated with said first solenoid coil for limiting the axial movement of said solenoid core and said pilot spool in one direction when said first solenoid coil is energized and a second threadably adjustable stop means associated with said second solenoid coil for limiting the axial movement of said solenoid core and said pilot spool in an opposite direction when said second solenoid is energized; whereby said valve spool shifts the same amount and direction as said pilot spool to restore the neutral position of said pilot spool relative to said valve spool and establish a flow rate thru said housing ports that is a function of said axial shifting distance of said pilot valve.

2. The apparatus of claim 1 plus resilient means opposing the displacement of said pilot spool in either direction from said neutral position.

3. The apparatus of claim 1 wherein said valve spool comprises a tubular element and further comprising annular sealing assemblies respectively mounted between the outer ends of said pilot spool and said axial bore of said housing to define fluid pressure chambers respectively cooperating with the end faces of said valve spool to apply fluid pressure forces thereto.

4. The apparatus of claim 1 further comprising a conduit connecting housing having a cylindrical bore for sealingly mounting said hollow housing, and internally threaded, conduit receiving, radial ports respectively aligned with said hollow housing ports.

* * * * *